US005588287A

United States Patent [19]

Lerner et al.

[11] Patent Number: 5,588,287

[45] Date of Patent: Dec. 31, 1996

[54] WRAPPING APPARATUS WITH BARRIER

[75] Inventors: Ruth Lerner; John Fain, both of Louisville, Ky.

[73] Assignee: Lantech, Inc., Louisville, Ky.

[21] Appl. No.: 490,763

[22] Filed: Jun. 15, 1995

Related U.S. Application Data

[63] Continuation-in-part of Ser. No. 338,165, Nov. 10, 1994, abandoned.

[51] Int. Cl.[6] ..... B65B 11/04

[52] U.S. Cl. ..... 53/588

[58] Field of Search ..... 53/77, 210, 211, 53/556, 587, 588

[56] References Cited

U.S. PATENT DOCUMENTS

| | | | |
|---|---|---|---|
| 4,077,179 | 3/1978 | Lancaster et al. . | |
| 4,450,668 | 5/1984 | Grossi | 53/587 X |
| 5,315,809 | 5/1994 | Gordon et al. . | |
| 5,450,709 | 9/1995 | Steding | 53/588 X |

FOREIGN PATENT DOCUMENTS

| | | | |
|---|---|---|---|
| 177413 | 4/1986 | European Pat. Off. | 53/588 |
| 279871 | 8/1988 | European Pat. Off. | 53/588 |
| 3615450 | 11/1987 | Germany | 53/556 |

OTHER PUBLICATIONS

Infra Pak Corporation, Super Spider.

Derwent Publications Ltd., Abstract of EP–117,413, 1986.

Derwent Publications Ltd., Abstract of DE–3,615,450, 1987.

Derwent Publications Ltd., Abstract of EP–279,871, 1988.

*Primary Examiner*—Linda Johnson

*Attorney, Agent, or Firm*—Finnegan, Henderson, Farabow, Garrett & Dunner,L.L.P.

[57] ABSTRACT

An apparatus for stretch wrapping a load with stretch wrap packaging material includes a dispenser for dispensing a sheet of stretch wrap packaging material and a turntable assembly for supporting and rotating a load about a generally vertical axis to wrap the sheet of stretch wrap packaging material around the load. The turntable assembly includes a generally horizontal support surface for supporting the load and a horizontally displaceable barrier mounted along at least a portion of the peripheral edge of the support surface a position normally spaced a greater distance from the vertical axis than the peripheral edge along which the displaceable barrier is mounted.

24 Claims, 12 Drawing Sheets

WRAPPING APPARATUS WITH BARRIER

RELATED APPLICATIONS

This application is a continuation-in-part of U.S. patent application Ser. No. 08/338,165, filed Nov. 10, 1994, now abandoned which is incorporated by reference herein.

BACKGROUND OF THE INVENTION

The present invention relates to a wrapping apparatus having a barrier,

When stretch wrapping loads with a sheet of stretch wrap packaging material, relative rotation is provided between a film web dispenser and a load. This generally is accomplished by one of two methods. Either the dispenser is rotated around the load, or the load is on a turntable. When using a turntable, the loads are deposited on the turntable, a leading end of the film web is secured to the load, turntable, or film clamps on the turntable, and the turntable is rotated so that a web of film is dispensed from a film web dispenser and wrapped around the load. U.S. Pat. No. 4,077,179 shows such an arrangement and is incorporated by reference for a more detailed description.

A variety of turntables have been used to rotate the load, and in some instances, such as with some machines which start automatically, rigid steel barriers, such as rails or cages, are used to prevent the machine operators and others from entering into the wrapping area and encountering the rotating turntable and components such as the load or film clamps that are positioned on the turntable. Such barriers hamper the ability of the machine operators to easily operate, load, and unload the turntable because they require the operator to manually move or remove the barriers to access the wrapping area each time such an operation is required.

Some stretch wrapping machines have a turntable that is eccentric or asymmetrical and includes portions which extend off-center of the remaining portions of the turntable to accommodate the film clamps, transition conveyors, motors for conveyor rollers or other devices used in wrapping the load. The off-center portions make the turntable wider than needed to support the load, and being at a greater distance from the axis of rotation and rotating at a wider arc than the rest of the turntable.

The portions of the turntable which are located closer to the axis of rotation than the off-center portions do not extend to the same radial distance as the off-center portions because standard fork trucks need to get close to the center of the turntable to deposit and retrieve loads at the center of the turntable with a single handling operation. Alternatives to the single handling operation by a fork truck include sequencing conveyors, infeed conveyors, and double handling where the truck puts the load down on the turntable and picks it up again by its edge to center it. However these operations take more time or require additional equipment.

When using a rotating dispenser, the load is trucked or conveyed to a support in a wrapping area where the dispenser is rotated around the load, usually circumscribing an area wider than the support. Barriers similar to those used with turntable designs have been used with rotating dispenser designs to protect machine operators and others.

The present invention provides a wrapping apparatus which permits safe and easy operation when depositing and retrieving loads from the turntable.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

In accordance with the invention, an apparatus is provided for wrapping a load with packaging material. The apparatus includes a dispenser for dispensing a sheet of packaging material. Means provide relative rotation between the dispenser in the load about a generally vertical axis to wrap the sheet of packaging material around the load. At least one of the dispenser and the means includes a member mounted for rotation along a path having a peripheral edge.

The apparatus also includes a horizontally displaceable barrier mounted along at least a portion of the peripheral edge of the path, the barrier having an outer surface at a position normally spaced at a greater distance from the vertical axis than the peripheral edge of the path along which the displaceable barrier is mounted.

According to an aspect of the invention, the means for providing relative rotation includes a turntable assembly having a turntable base, a generally horizontal turntable with a support surface for supporting a load and mounted in the base for rotation about a generally vertical axis, the support surface having a peripheral edge. In addition, the turntable assembly includes a horizontally displaceable barrier mounted along at least a portion of the peripheral edge of the support surface, the barrier having an outer surface at a position normally spaced a greater distance from the vertical axis than the peripheral edge of the support surface along which the displaceable barrier is mounted.

According to an aspect of the invention, it is preferable that the peripheral edge of the support surface includes a first portion that rotates at an arc which is at a greater distance from the vertical axis than a second portion, and the displaceable barrier is located along the second portion and mounted to the support surface.

According to another aspect of the invention, a shield is provided extending between the displaceable barrier and the peripheral edge of the support surface for permitting displacement of the displaceable barrier relative to the peripheral edge of the support surface and for preventing vertical access between the displaceable barrier and the peripheral edge of the support surface.

It is to be understood that both the foregoing general description and the following detailed description are exemplary and explanatory only and are not restrictive of the invention, as claimed.

BRIEF DESCRIPTION OF THE DRAWINGS

The accompanying drawings which are incorporated in and constitute a part of the specification, illustrate an embodiment of the invention and, together with the description, serve to explain the principles of the invention.

DETAILED DESCRIPTION OF THE PREFERRED EMBODIMENTS

Figure 1:
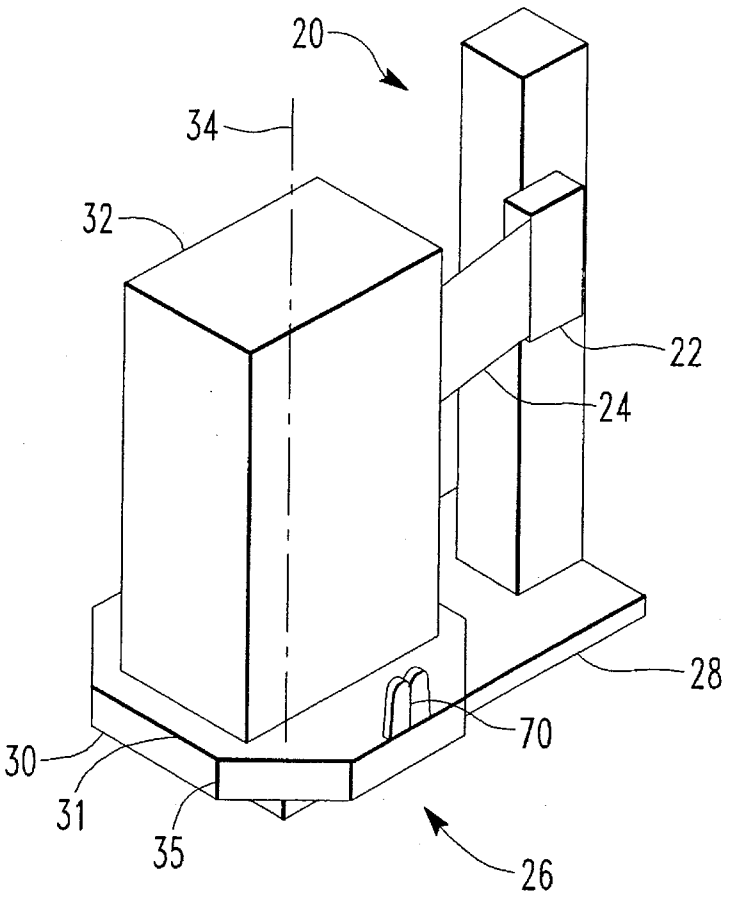
FIG. 1 is a perspective view of a stretch wrapping apparatus incorporating the teachings of the present invention.

Reference will now be made in detail to the present preferred embodiments of the invention, examples of which are illustrated in the accompanying drawings. In some instances, similar reference characters will be used in the drawings to refer to the same or like parts.

According to the present invention, an apparatus is provided for wrapping a load with packaging material. As shown in FIG. 1, an apparatus 20 includes a stretch wrapping dispenser 22 for dispensing and stretching a sheet 24 of stretch wrap packaging material and a turntable assembly 26. Various dispensers are shown and described in further detail in U.S. Pat. No. 5,161,349, which is incorporated by reference.

Figure 2:
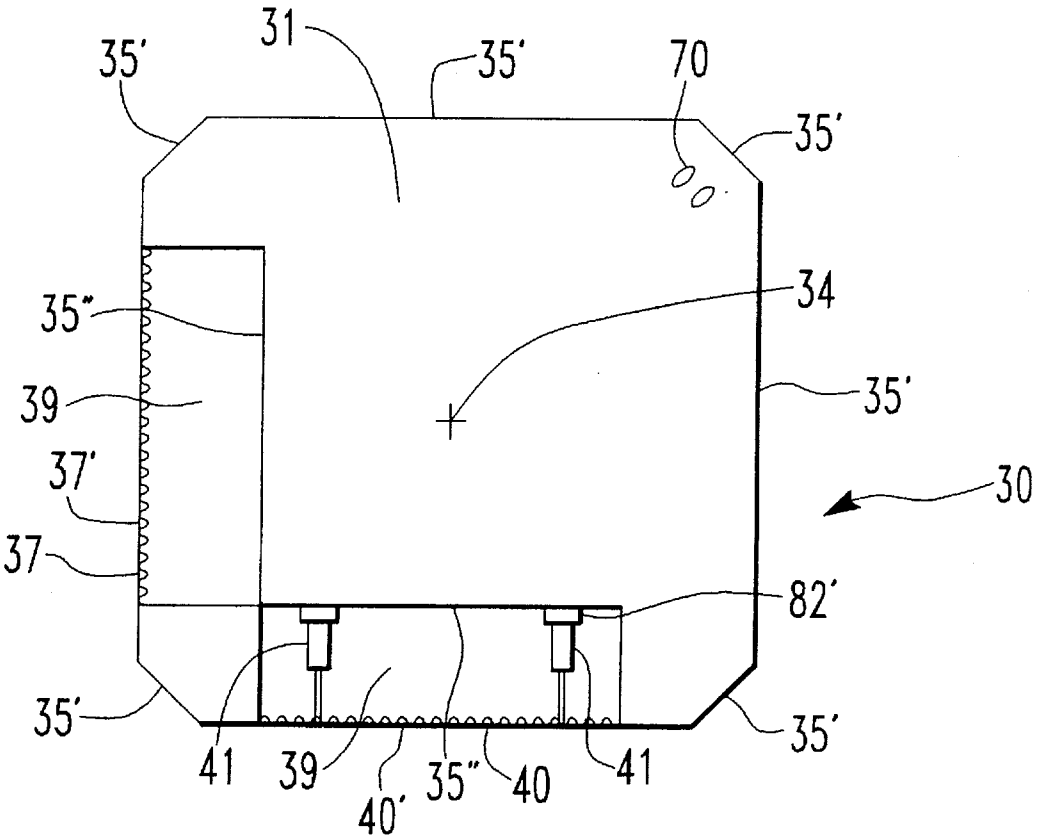
FIG. 2 is a top plan view of the turntable assembly shown in FIG. 1.

The turntable assembly 26 includes a turntable base 28 and a powered generally horizontal turntable 30 having a support surface 31 for supporting a load 32 and mounted in the base 28 for rotation about a generally vertical axis 34. The support surface 31 of the embodiment shown in FIG. 1 is preferably rigid and non-deflective in being able to support the load, and it includes a generally symmetrical octagonal steel plate having a peripheral edge 35. As shown in FIG. 2, the peripheral edge 35 preferably includes a first portion 35' and a second portion 35". Various devices, such as conventional film clamps 70, are mounted on the support surface 31 near the first portion 35' of the peripheral edge.

According to the present invention, the turntable assembly includes a horizontally displaceable barrier mounted along at least a portion of the peripheral edge of the support surface, the barrier having an outer surface at a position normally spaced a greater distance from the vertical axis than the peripheral edge of the support surface along which the displaceable barrier is mounted. The displaceable barrier can be constructed of various materials and elements, or combinations of various materials and elements such as a flexible member, a stretchable elastomeric member, a bar supported at its ends by springs, a compressible member such as a foam bumper, or an inflexible but displaceable member such as that shown in FIG. 2 as rigid bar 40, having outer surface 40. Bar 40 is supported by hydraulic or pneumatic cylinder assemblies 41, which can be resiliently compressed so that bar 40 may move from its original normal position to approach the second portion 35" of the periphery of the support surface 31.

As shown in FIG. 2, the horizontally displaceable barrier includes barriers 37, with outer surface 37', formed of a flexible sheet of spring steel and mounted with springs or other stretchable elastomeric members at its ends to close off a pocket area 39 formed by the second portion 35" of the peripheral edge of the support surface 31. Although FIG. 2 shows two pockets 39, there may be only one pocket, or more than two pockets, or pockets of different shapes and sizes, and still be within the scope of the present invention.

Preferably, the barriers 37 or 40 are constructed so that they resist substantial displacement by an operator but permit substantial displacement when encountering a loading truck. By such an arrangement, barriers 37 and 40 provide a boundary for human operators so they do not venture past the barrier and encounter a portion of the turntable assembly inside the outer arc of that portion. Barriers 37 and 40 can be substantially displaced into pocket 39 by fork trucks or other loading trucks which can be driven into pockets 39 to deposit and retrieve loads from the center of turntable 30. Barriers 37 and 40 preferably return automatically to their original positions after being displaced. It is preferable that barriers 37 and 40 resist substantial displacement when encountering a human operator to prevent the human operator from entering into pocket 39.

Figure 3:
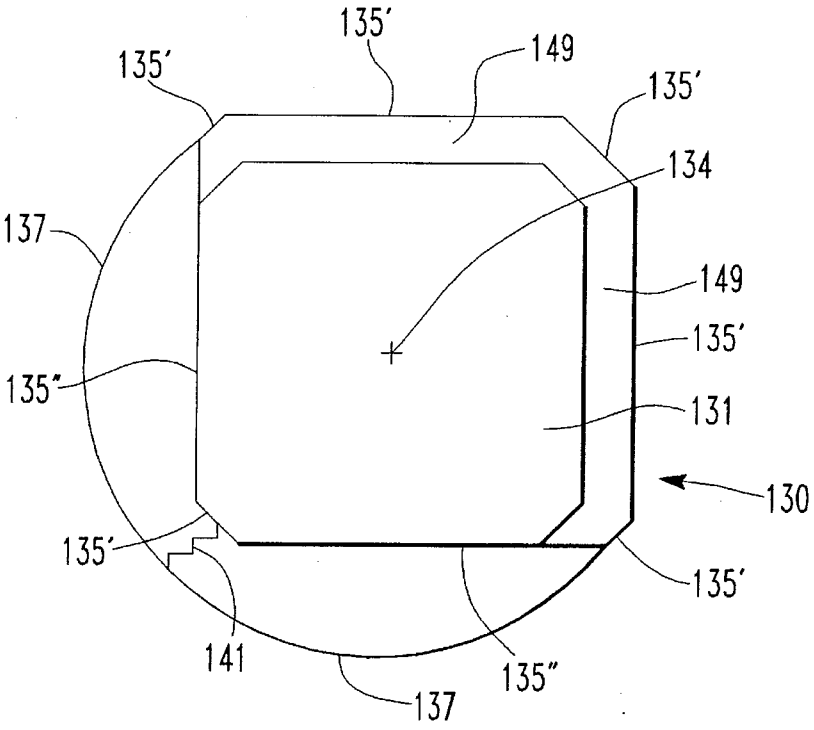
FIG. 3 is a top plan view of a second embodiment of the turntable assembly incorporating the teachings of the present invention.

FIG. 3 shows another embodiment of the present invention in which an asymmetrical turntable 130 has an off-center asymmetrical portion relative to vertical axis 134, with a first peripheral portion 135' that rotates in an arc which is a greater distance from vertical axis 134 than a second portion 135" and a flexible displaceable barrier 137. The first portion 135' of the peripheral edge of the support surface 131 and barrier 137 form the periphery of an area which is generally symmetrical about the generally vertical axis 134 and in so doing form a symmetrical clearance area. Flexible displaceable barrier 137 may be constructed to operate in the same fashion as the barrier 37 in FIG. 2, and include, for instance, a piece of spring steel 137 attached at opposite ends to the portion where the first and second peripheral portions 135' and 135" meet. The flexible barrier 137 is longer than the second peripheral portion 135" so that when attached at opposite ends, the steel piece is supported spaced from the second peripheral portion 135". A resilient piston and cylinder assembly 141 supports the displaceable barrier 137 intermediate its ends.

Figure 4:
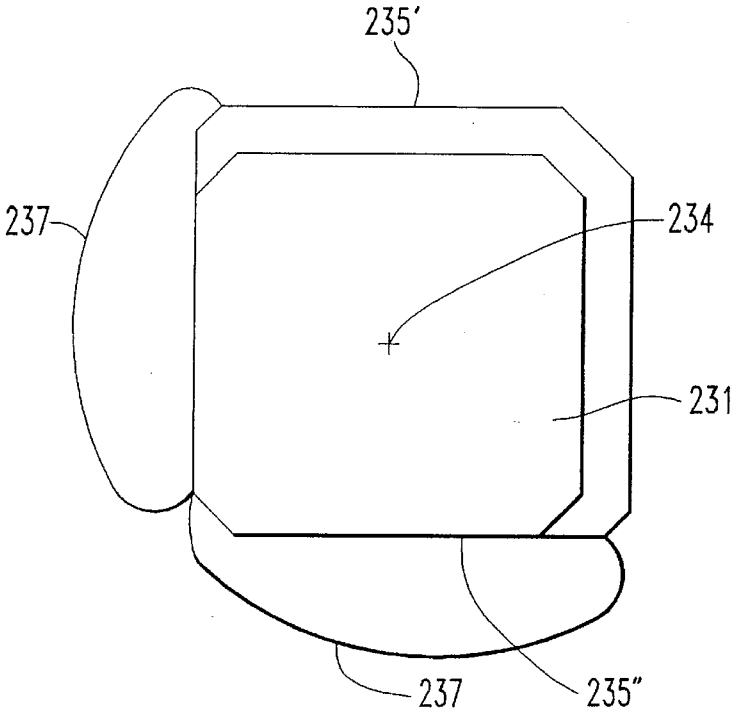
FIG. 4 is a top plan view of a third embodiment of a turntable assembly incorporating the teachings of the present invention.

Another alternative arrangement is shown in FIG. 4, where two flexible displaceable barriers 237 are each longer than the peripheral portions to which they are attached. Other arrangements, configurations, and numbers of barriers may also be used and remain in the scope of the present invention.

Figure 5:
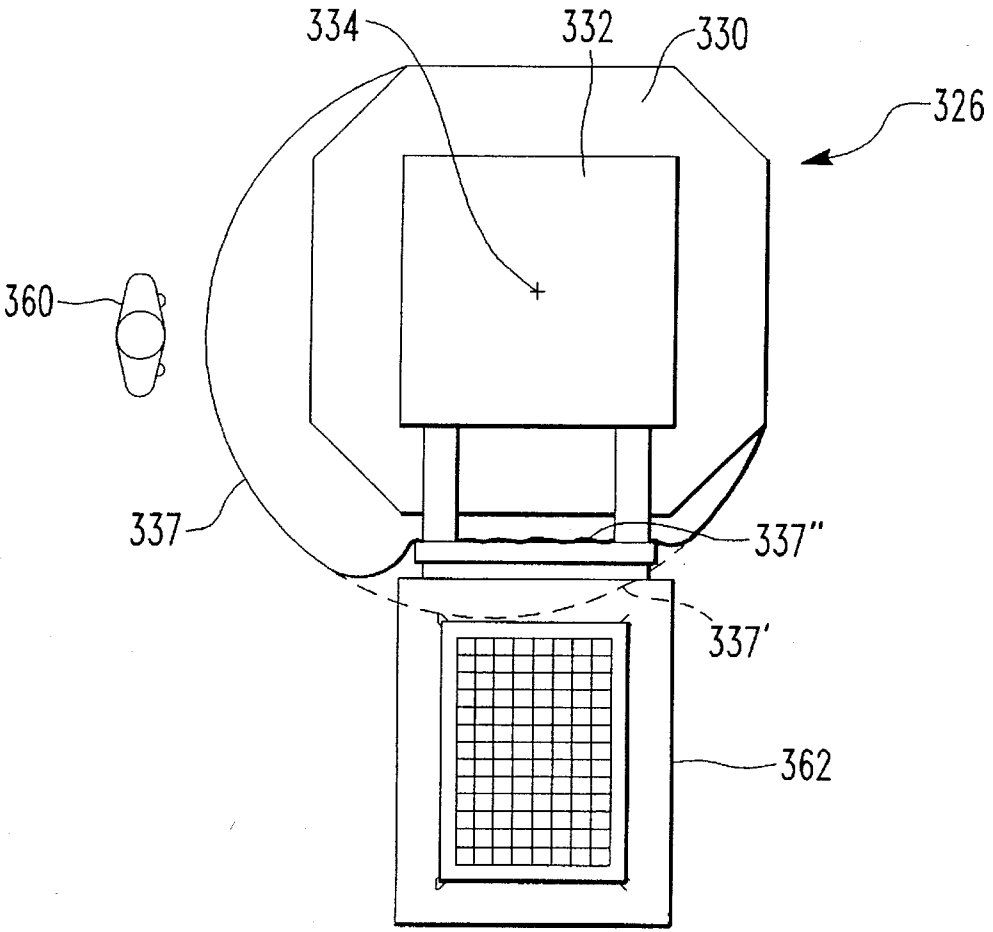
FIG. 5 is a top plan view of a fourth embodiment of a turntable assembly incorporating the teachings of the present invention with a load truck positioning the load on the turntable.

As shown in FIG. 5, turntable assembly 326 includes a single flexible barrier 337 which resists substantial displacement when encountering a human operator 360 and permits substantial displacement of flexible barrier 337 from position 337' shown in broken line, to position 337" shown in solid line, when compressed by a loading truck such as fork truck 362. Barrier 337 preferably includes spring steel, which is compressed to position 337" by truck 362, and which springs back to position 337' when truck 362 moves away. In this way, barrier 337 permits truck 362 to deposit and retrieve load 332 on the center of turntable 330. This can be done, for example by using spring steel, springs, or other devices.

Figure 6:
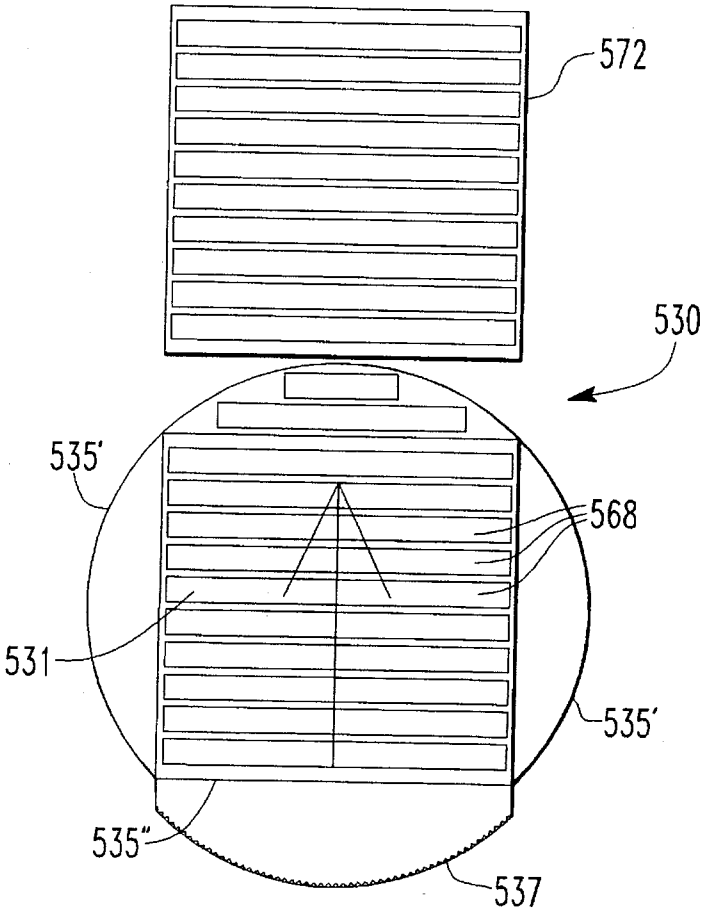
FIG. 6 is a top plan view of a fifth embodiment of a turntable assembly incorporating the teachings of the present invention.

FIG. 6 shows a turntable 530 including a support surface formed of a roller conveyor including rollers 568 having a periphery with a first portion 535' which forms a generally circular arc, and a flattened second portion 535". A displaceable barrier 537 is mounted along second portion 535" so that turntable 530 includes a generally circular periphery. In the embodiment shown in FIG. 6, a fork truck can compress barrier 537 to deposit a load on a support surface 531. The load may then be wrapped and subsequently removed from turntable 530 by powering rollers 568, depositing load on downstream roller conveyor 572.

Figure 7:
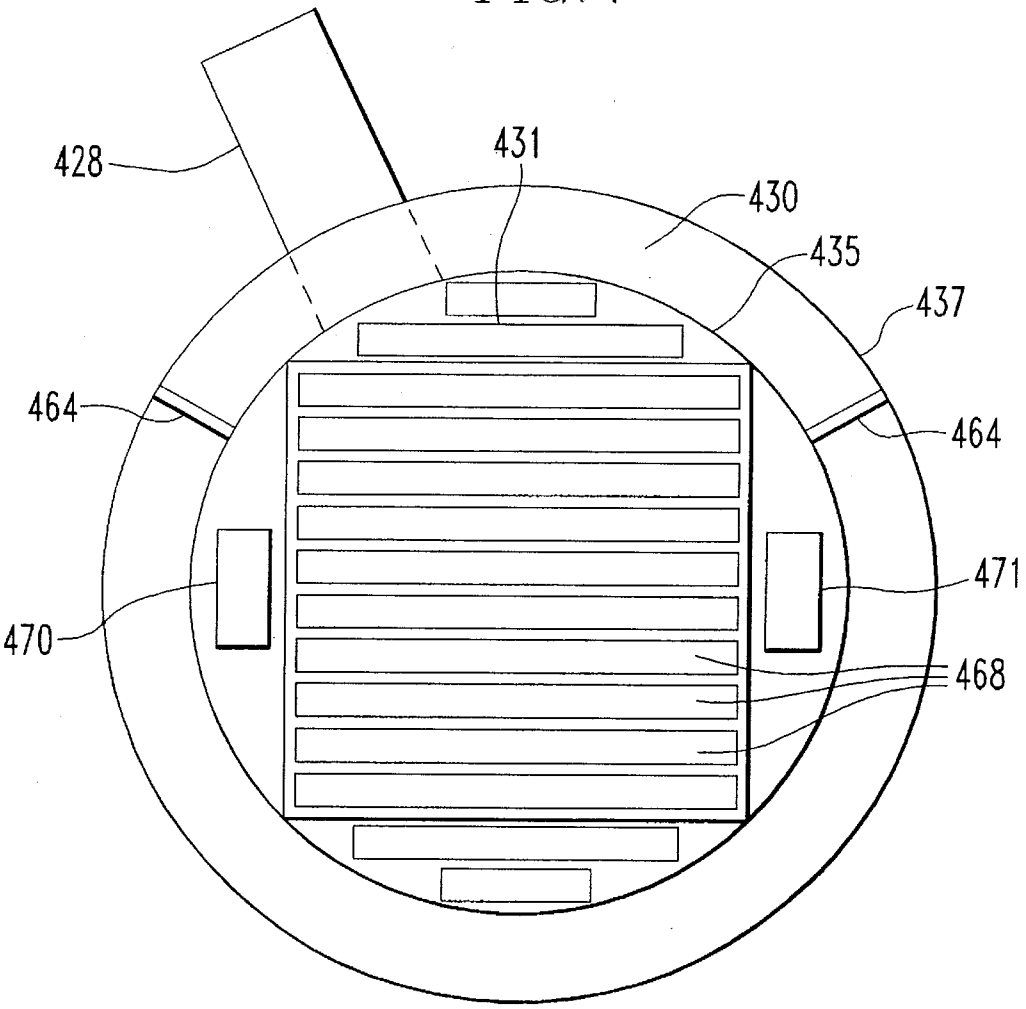
FIG. 7 is a top plan view of a sixth embodiment of a turntable assembly incorporating the teachings of the present invention.

As shown in FIG. 7, support surface 431 includes a roller conveyor formed of a series of driven rollers 468 which convey the load onto and off of the turntable. Conventional film clamps 470 and motor 471 for driving rollers 468 are mounted on support surface 431. A displaceable barrier 437 surrounds the complete perimeter of the peripheral edge 435 of the support surface 431. In this embodiment, flexible barrier 437 may be mounted to support surface 431 by supports 464 such as springs, pistons, and cylinders, so barrier 437 rotates with support surface 431. Alternatively, barrier 437 may be mounted to the turntable base 428 so that it does not rotate with the support surface 431.

According to the present invention, a switch is operatively connected to the displaceable barrier for controlling power to the turntable, the switch interrupting power to the turntable motor when the displaceable barrier is displaced in a the horizontal direction. In so doing, the turntable is stopped or prevented from starting when the flexible barrier is displaced a predetermined amount in the horizontal direction.

Figure 8:
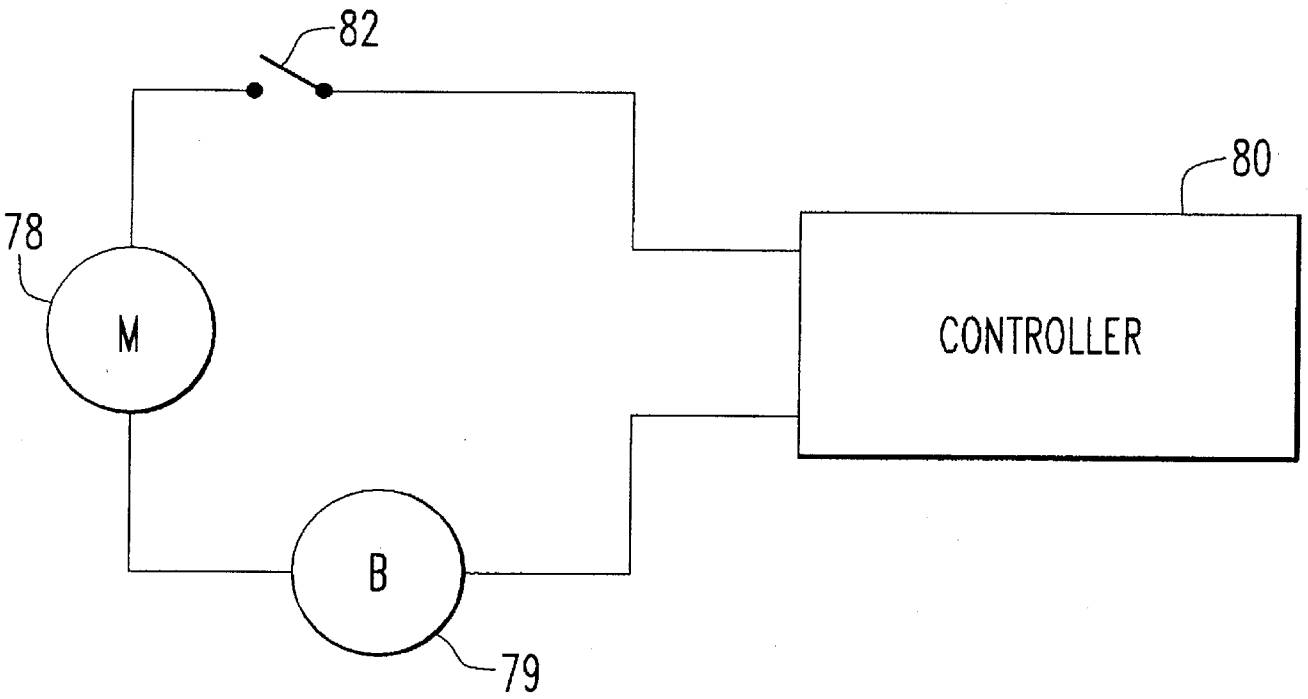
FIG. 8 is a schematic diagram of part of the control circuitry for interrupting rotation of the turntable.

As shown in FIG. 8, a turntable motor 78 generally receives power throughout the wrapping sequence from a controller 80, which may be an operator controlled switch, a microprocessor, a programmable controller, or other devices which perform that function. This power may be interrupted by switch 82, which could be a limit switch or other device which is disengaged when the barrier is displaced from its normal position. For example, the switch 82 may be integrated into cylinder 41, so that when cylinder 41 compresses, switch 82 is opened, so that it cuts off power to the turntable motor 78 and stops the motor 78 or prevents the motor 78 from starting up, thereby protecting an operator who encounters the barrier or displaces it an insubstantial amount.

As also shown in FIG. 8, a brake 79 generally receives power throughout the wrapping sequence from a controller 80. The power may be interrupted by switch 82, which is disengaged when the barrier is displaced from its normal position so that it cuts off power to the brake, allowing the brake to engage and brake the rotation of the turntable when the displaceable barrier is displaced. The brake may be operatively connected to the displaceable barrier by a mechanical linkage which operates when the displaceable barrier is displaced. An example of sensing devices, control devices, and emergency stop devices which may be used are shown in U.S. Pat. No. 5,315,809, which is incorporated by reference.

Figure 9:
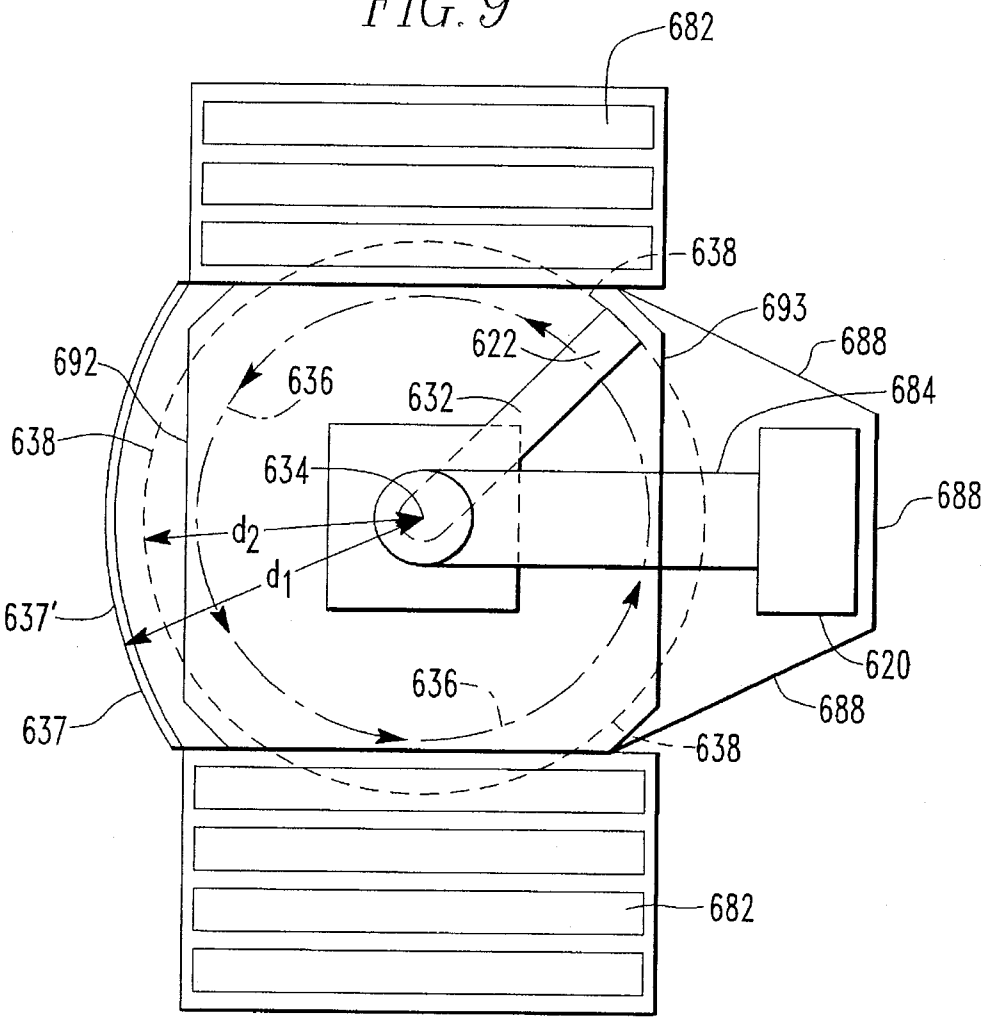
FIG. 9 is a top plan view of a seventh embodiment of a stretch wrapping apparatus incorporating the teachings of the present invention.
Figure 10:
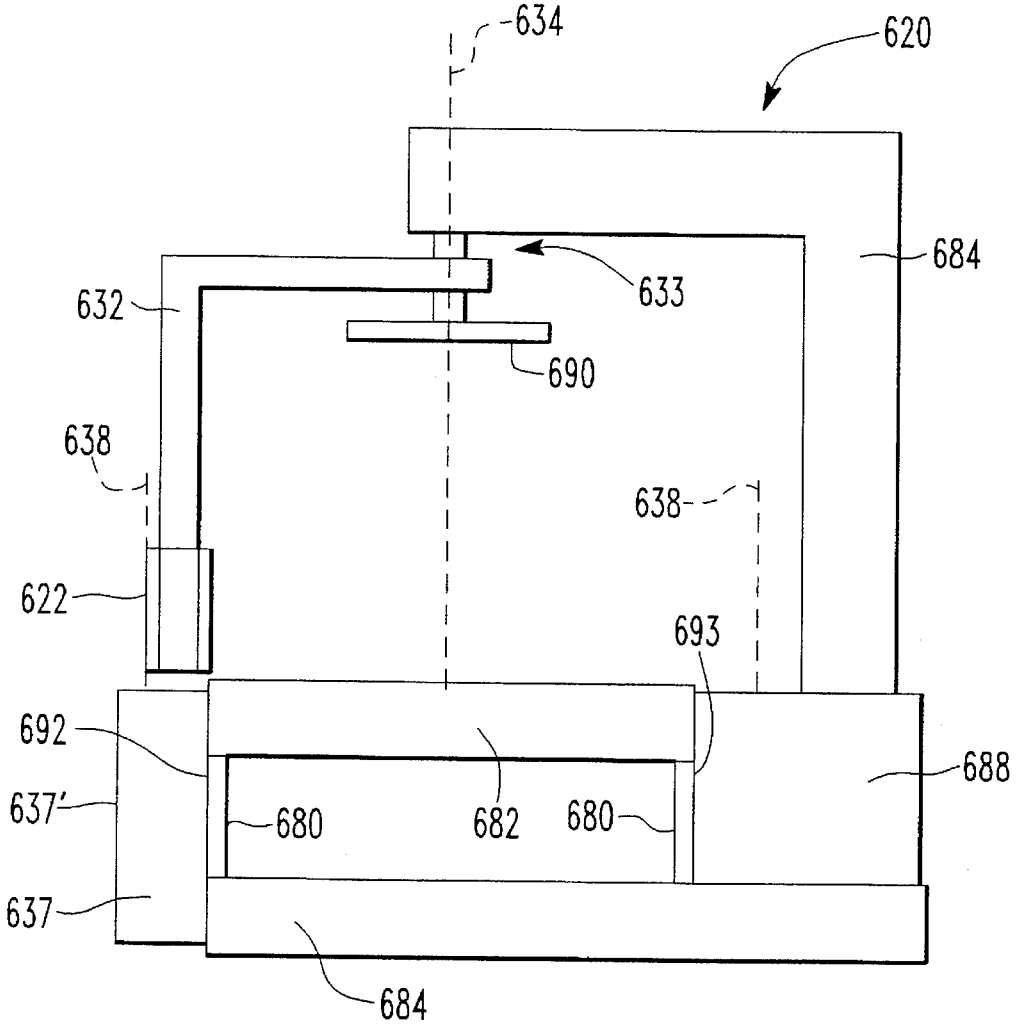
FIG. 10 is a side view of the apparatus shown in FIG. 9 at a different position in the wrapping cycle.

According to another aspect of the invention, an apparatus is provided for wrapping a load with packaging material in which the dispenser is rotated around the load. Such an apparatus includes means for rotating the dispenser about a generally vertical axis along a path having a peripheral edge to wrap the sheet of packaging material around the load. As shown in FIGS. 9 and 10, the means for rotating the dispenser 622 includes an L-shaped arm 632 for supporting dispenser 622 and a motor-driven bearing 633 for driving the L-shaped arm 632 for rotation about a generally vertical axis 634. The dispenser 622 and its support 632 are rotated along a path 636 having a peripheral edge 638.

According to this aspect of the invention, the horizontally displaceable barrier is mounted along at least a portion of the peripheral edge of the path, and the barrier has an outer surface at a position normally spaced at a greater distance from the vertical axis than the peripheral edge of the path along which the displaceable barrier is mounted. As shown in FIGS. 9 and 10, the horizontally displaceable barrier includes barrier 637 formed of a flexible sheet of spring steel and mounted to the frame 680 of roller conveyor 682 and the frame 684 of wrapping apparatus 620. Barrier 637 is mounted along a portion of the peripheral edge 638 of the path 636. The barrier 637 has an outer surface 637' at a position normally spaced at a greater distance $d_1$ from the vertical axis 634 than the distance $d_2$ of the peripheral edge 638 of the path 636 along which the barrier 637 is mounted. As shown in the embodiments in FIGS. 9 and 10, the peripheral edge 638 of the path 636 of the dispenser is outside the side boundaries 692 and 693 of roller conveyor 682.

Barriers 688 are provided around the portion of the wrapping apparatus 620 which is not accessed by a forklift. Barriers 688 need not be displaceable or flexible. The height, shape, and construction of barriers 637 and 688 may be varied in accordance with the application with which they are used. Various other devices, such as top platen 690, may be used in carrying out the stretch wrapping operation if necessary.

Figure 11:
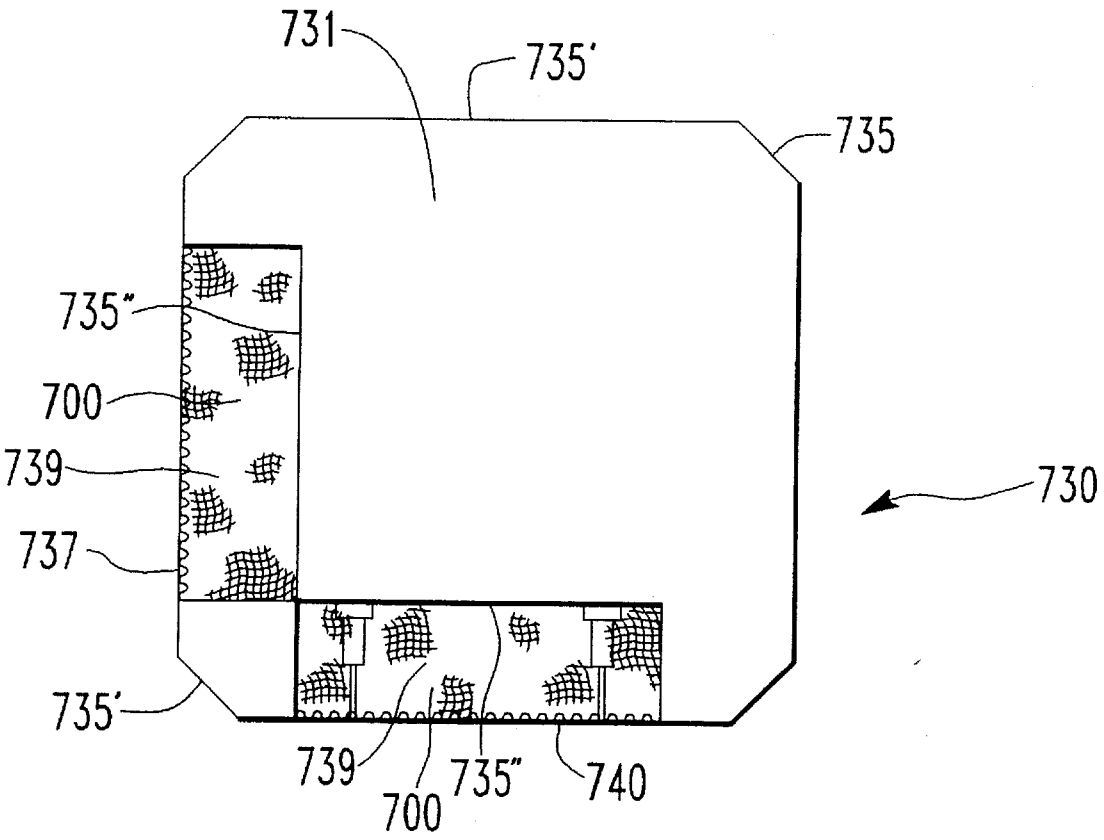
FIG. 11 is a top plan view of an eighth embodiment of a stretch wrapping apparatus incorporating the teachings of the present invention with a barrier in a non-displaced position and a shield.
Figure 12:
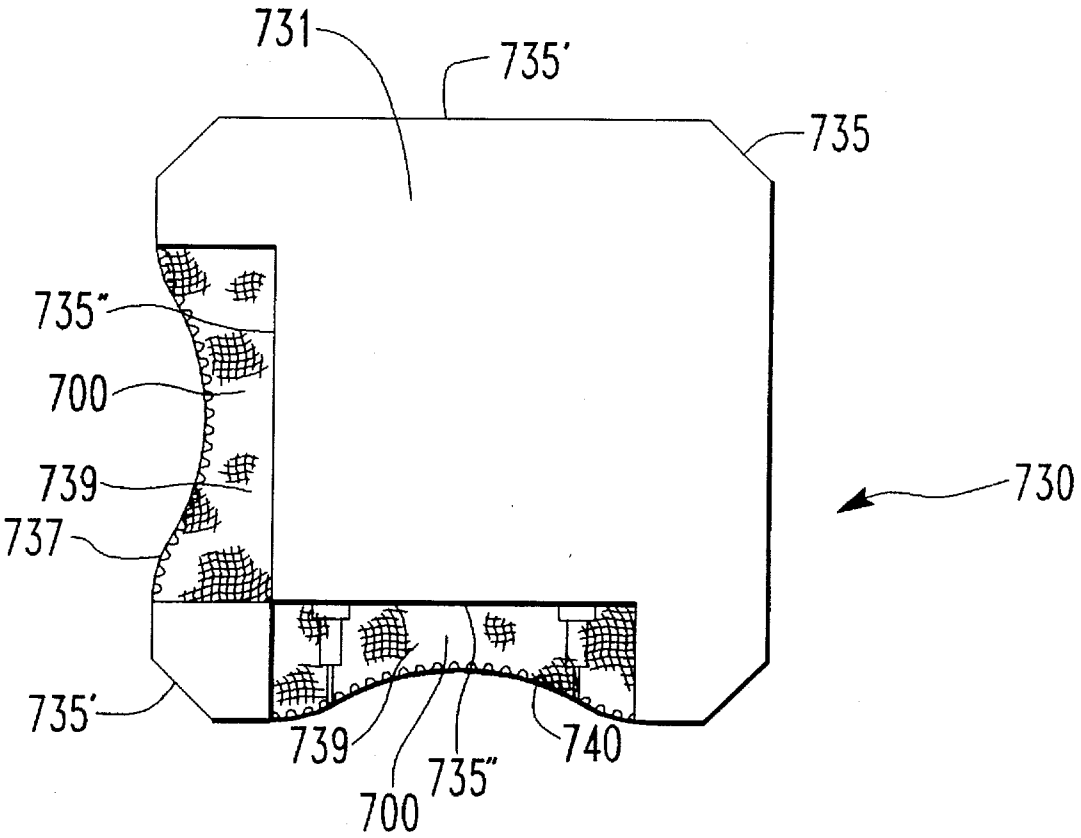
FIG. 12 is a top plan view of the apparatus shown in FIG. 11 with the barrier in a displaced position.

As an option, according to another aspect of the invention shown in FIGS. 11 and 12, a shield 700 may be provided between the displaceable barrier 737 or 740 and the second portions 735" of the peripheral edge support surface 731. The shield 700 may be a fabric cover or other arrangement for permitting displacement of the displaceable barriers 737 and 740 relative to the peripheral edge of the support surface 731 and for preventing vertical access between the displaceable barriers 737 and 740 and the peripheral edge of the support surface 731.

Barriers 737 and 740 are similar to barriers 37 and 40 of FIG. 2. FIG. 11 shows the barriers 737 and 740 in a non-displaced position, and FIG. 12 shows the barriers in a displaced position. As shown in FIG. 12, when the barriers 737 and 740 are displaced, the shields 700 are also displaced. The shield 700 prevents potential injury to a user of the turntable 730 during movement of the barriers 737 or 740 by preventing access the pocket areas 739 between the barriers and support surface 731. While FIGS. 11 and 12 show a shield 700 used on the device of FIG. 2, it should be understood that the shield 700 may be used with any of the embodiments of the present invention discussed above.

Preferably, the shield 700 is a piece of fabric that is substantially taut when the barriers 737 and 740 are in the position shown in FIG. 11. The fabric may be made of any flexible material such as canvas, wire meshing, or plastic within the scope of the invention. The shield 700 may be secured to the support surface 731 and barriers 737 or 740 by any suitable means such as velcro, snaps, or other fasteners.

Alternately, the shield 700 may comprise a stronger material such as a pleated, accordion-like member, or a plurality rods or a plate extending from the support surface 731 and moveable into the support surface when the barriers 737 or 740 are displaced.

Figure 13:
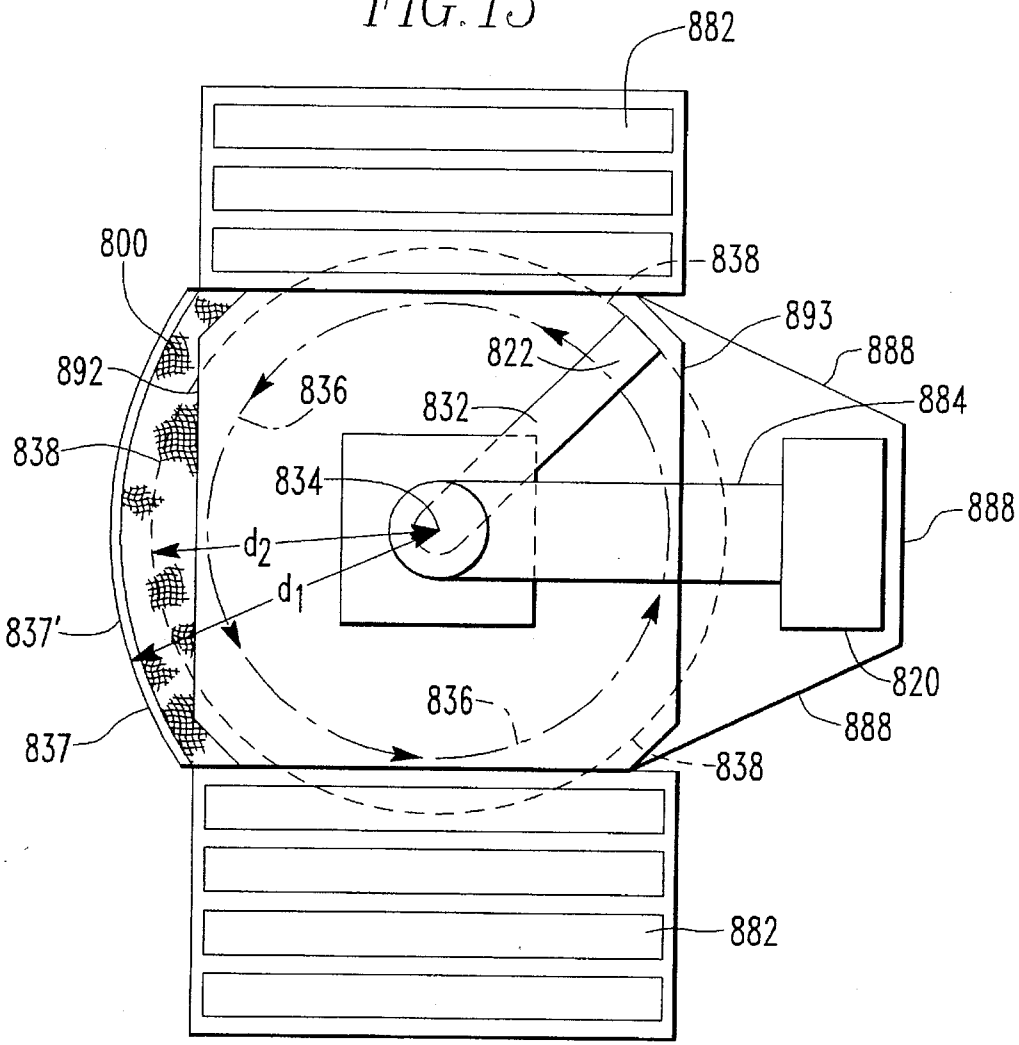
FIG. 13 is a top plan view of the apparatus shown in FIG. 9 including a shield.

Similar shields may be used on other embodiments as well. For example, as shown in FIG. 13, a shield 800 may be employed with the device of FIGS. 9 and 10. In FIG. 13, the reference numerals used to identify like elements of the wrapping apparatus are similar to those in FIGS. 9 and 10, except the reference numerals in FIG. 13 begin with an "8".

In the device of FIG. 13, the shield 800 extends from the displaceable barrier 837 toward the generally vertical axis 834. The shield 800 permits displacement of the displaceable barrier 837 relative to the axis 834 and prevents vertical access to between the barrier and the peripheral edge 838 of the path 836. The shield 800 operates similarly to shield 700 of FIGS. 11 and 12, and may be constructed of similar materials.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims and their equivalents.

What is claimed is:

1. An apparatus for wrapping a load with packaging material comprising:

a dispenser for dispensing a sheet of packaging material;

a turntable assembly including a turntable base and a powered turntable having a generally horizontal support surface for supporting the load and mounted in the base for rotation about a generally vertical axis to wrap the sheet of packaging material around the load, the support surface having a peripheral edge;

a horizontally displaceable barrier mounted to the turntable for rotation with the turntable and positioned along at least a portion of the peripheral edge of the support surface, the barrier having an outer surface at a position normally spaced at a greater distance from the vertical axis than the peripheral edge of the support surface along which the displaceable barrier is mounted; and means for automatically returning the barrier to its normally spaced position after being horizontally displaced.

2. The wrapping apparatus of claim 1, wherein the peripheral edge of the support surface includes a first portion that extends a greater distance from the vertical axis than a second portion, and the displaceable barrier is located along the second portion.

3. The wrapping apparatus of claim 1, wherein the peripheral edge of the support surface includes a first portion that extends a greater distance from the vertical axis than a second portion, and the displaceable barrier is located along the second portion with the outer surface of the barrier at a position normally spaced from the vertical axis at a distance at least as great as the distance from the first portion to the vertical axis.

4. The wrapping apparatus of claim 2, wherein the displaceable barrier is located only along the second portion.

5. The wrapping apparatus of claim 1, wherein the displaceable barrier is mounted to the support surface.

6. The wrapping apparatus of claim 1, wherein the displaceable barrier is mounted to the support surface, the peripheral edge of the support surface includes a first portion that extends a greater distance from the vertical axis than a second portion, and the displaceable barrier is located along the second portion.

7. The wrapping apparatus of claim 6, wherein the displaceable barrier is located only along the second portion.

8. The wrapping apparatus of claim 6, wherein the second portion forms a pocket area and the displaceable barrier closes off the pocket area.

9. The wrapping apparatus of claim 6, wherein the peripheral edge of the support surface is generally symmetrical about the generally vertical axis, the second portion forms a pocket area, and the displaceable barrier closes off the pocket area.

10. The wrapping apparatus of claim 6, wherein the peripheral edge of the support surface is generally asymmetrical about the generally vertical axis, and the displaceable barrier and first portion form an area having a perimeter generally symmetrical about the vertical axis.

11. The wrapping apparatus of claim 6, wherein the peripheral edge of the support surface is eccentric about the generally vertical axis, and the displaceable barrier and first portion form an area having a perimeter at a generally constant distance from the vertical axis.

12. The wrapping apparatus of claim 6, wherein the displaceable barrier is configured and positioned to reduce the eccentricity of the turntable perimeter about the vertical axis.

13. The wrapping apparatus of claim 6, including clamps mounted on the support surface near the first portion.

14. The wrapping apparatus of claim 1, wherein the displaceable barrier surrounds the complete perimeter of the support surface.

15. The wrapping apparatus of claim 5, wherein the displaceable barrier surrounds the complete perimeter of the peripheral edge of the support surface.

16. The wrapping apparatus of claim 1, wherein the support surface includes a roller conveyor.

17. The wrapping apparatus of claim 16, including a motor mounted on the support surface near the first portion for driving the roller conveyor.

18. The wrapping apparatus of claim 1, wherein the displaceable barrier is a flexible barrier which flexes when displaced and returns to its original position after being displaced.

19. The wrapping apparatus of claim 1, wherein the displaceable barrier includes at least one displaceable elastomeric member which returns to its original position after being displaced.

20. The wrapping apparatus of claim 1, wherein the displaceable barrier resists substantial displacement when encountering a human operator and permits substantial displacement when encountering a loading truck.

21. The wrapping apparatus of claim 1, including a switch operatively connected to the displaceable barrier for controlling power to a motor for powering the rotation of the turntable, wherein the switch interrupts power to the motor when the displaceable barrier is displaced in the horizontal direction.

22. The wrapping apparatus of claim 1, including a brake operatively connected to the displaceable barrier for braking rotation of the turntable in response to displacement of the displaceable barrier.

23. The wrapping apparatus of claim 1, including a shield extending between the displaceable barrier and the peripheral edge of the support surface for permitting displacement of the displaceable barrier relative to the peripheral edge of the support surface and for preventing vertical access between the displaceable barrier and the peripheral edge of the support surface.

24. The wrapping apparatus of claim 23, wherein the shield includes a fabric.

* * * * *